US007892033B2

(12) United States Patent
Huang et al.

(10) Patent No.: US 7,892,033 B2
(45) Date of Patent: Feb. 22, 2011

(54) ELECTRICAL CONNECTOR ENSURING PROPER CONNECTION

(75) Inventors: Lin Huang, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 149 days.

(21) Appl. No.: 12/287,913

(22) Filed: Oct. 14, 2008

(65) Prior Publication Data

US 2009/0098774 A1 Apr. 16, 2009

(30) Foreign Application Priority Data

Oct. 12, 2007 (CN) ..... 2007 2 0043631 U

(51) Int. Cl.
*H01R 24/00* (2006.01)

(52) U.S. Cl. ..... 439/626

(58) Field of Classification Search ..... 439/626, 439/157, 160, 152, 377, 637, 328, 372
See application file for complete search history.

(56) References Cited

U.S. PATENT DOCUMENTS

| | | | | |
|---|---|---|---|---|
| 3,932,016 | A * | 1/1976 | Ammenheuser | 439/377 |
| 5,425,651 | A * | 6/1995 | Thrush et al. | 439/326 |
| 5,511,985 | A * | 4/1996 | Noschese et al. | 439/157 |
| 5,637,004 | A * | 6/1997 | Chen et al. | 439/157 |
| 5,730,611 | A * | 3/1998 | Cheng et al. | 439/160 |

* cited by examiner

*Primary Examiner*—Alexander Gilman
(74) *Attorney, Agent, or Firm*—Wei Te Chung; Andrew C. Cheng; Ming Chieh Chang

(57) ABSTRACT

An electrical connector comprises a dielectric housing and a plurality of conductive contacts. The dielectric housing defines a receiving slot comprising opposite upper inner wall and lower inner wall, a pair of opposite side inner walls respectively intersecting the upper inner wall and lower inner wall, and a pair of fulcrums respectively defined on the pair of side inner walls. The plurality of conductive contacts is disposed in the dielectric housing with a contacting portion extending into the receiving slot from the upper wall or lower wall and disposed along a common line. Wherein, the fulcrums are disposed at the nearest places to the common line on the side inner walls.

11 Claims, 6 Drawing Sheets

ELECTRICAL CONNECTOR ENSURING PROPER CONNECTION

BACKGROUND OF THE INVENTION

1. Field of the Invention

The present invention is generally related to the art of electrical connector and more particularly to an electrical connector having fulcrums on its engaging portion for ensuring proper connection with a complementary electrical connector even engage the complementary electrical connector along an inaccurate direction rotate a certain angle from the definite coupling direction.

2. Description of Related Art

Low profile connectors, such as those used in SFP (Small Form Factor Pluggable) and SFP-like applications are desired in electronic devices in which space is a premium and thus it is difficult to control the impedance by modifying the spacing and size of the terminals in a reduced-size connector housing. When the terminals are modified, it becomes difficult to retain all of the mechanical functions of the connector, such as terminal retention and engagement while tuning the impedance of the connector. It is also difficult, due to the small size of the SFP-style connectors to provide the connector with some sort of keying function that will ensure proper mating with an opposing mating connector.

U.S. Pat. No. 7,198,519 issued to Regnier, et al. on Apr. 3, 2007 discloses an invention directed to edge card connectors in which the connector impedance may be controlled by shaping of the connector terminals and in which the connector includes a means for ensuring proper connection with an opposing, mating connector. In this invention a surface mount connector providing a connection between a circuit board and an opposing electronic element, for high speed data transfer application. The circuit board having a plurality of conductive traces disposed thereon, and the opposing electronic element including a male portion having a plurality of conductive members disposed thereon. The connector has an insulative housing with a circuit card-receiving slot disposed along a front face thereof. A plurality of conductive terminals are supported by the housing so that contact portions of the terminals extend into the card slot. The terminals are supported on opposite faces of the connector housing, specifically the top and bottom faces thereof, and each of the terminals includes a tail portion, a contact portion and a retention portion that engages the connector housing so that the contact portions are cantilevered in their extent within the housing. The terminals are divided into two distinct sets of terminals that are spaced apart from each other on opposite sides of the circuit card-receiving slot of the connector housing. The housing includes a hollow recess formed on its bottom that opens to the front of the connector housing. This recess serves as a keyway that may receive a male portion of an opposing mating connector to ensure the mating connector is oriented properly before engagement.

Usually, when the opposing electronic element is inserted into the connector along a definite direction, the male portion of the opposing electronic element will properly received in the receptacle portion of the connector, yet if the inserting direction is pivot an angle from the definite direction, a collision will emerge between the male portion and the receptacle portion. For the opposing electronic element has a long handle body, the principle of leverage tells us, a large force will be exerted over a small distance at the male portion by exerting only a small force over a greater distance at the handle body, so damage will come out due to the large force collision.

Hence, an improved electrical connector is required to overcome the disadvantages of the prior art.

SUMMARY OF THE INVENTION

Accordingly, an object of the present invention is to provide an electrical connector ensuring proper connection.

In order to achieve the above-mentioned object, a female electrical connector comprises a dielectric housing and a plurality of conductive contacts. The dielectric housing defines a receiving slot comprising opposite upper inner wall and lower inner wall, a pair of opposite side inner walls respectively intersecting the upper inner wall and lower inner wall, and a pair of fulcrums respectively defined on the pair of side inner walls. The plurality of conductive contacts is disposed in the dielectric housing with a contacting portion extending into the receiving slot from the upper wall or lower wall and disposed along a common line. Wherein, the fulcrums are disposed at the nearest places to the common line on the side inner walls.

In order to achieve the above-mentioned object, a male electrical connector comprises a dielectric housing and a plurality of conductive contacts. The dielectric housing comprises a tongue board adapted to insert in an elongate rectangular receiving slot of a complementary female connector along an inserting direction, the tongue board defines a mating face parallel to the inserting direction. Each the conductive contact comprises a contacting section disposed on the mating face of the tongue board. Wherein, the tongue board has a pair of fulcrums symmetrically projecting on two opposite sides thereof positioned adjacent to the contacting section.

Other objects, advantages and novel features of the present invention will become more apparent from the following detailed description of the present embodiment when taken in conjunction with the accompanying drawings.

DETAILED DESCRIPTION OF THE INVENTION

Figure 1:
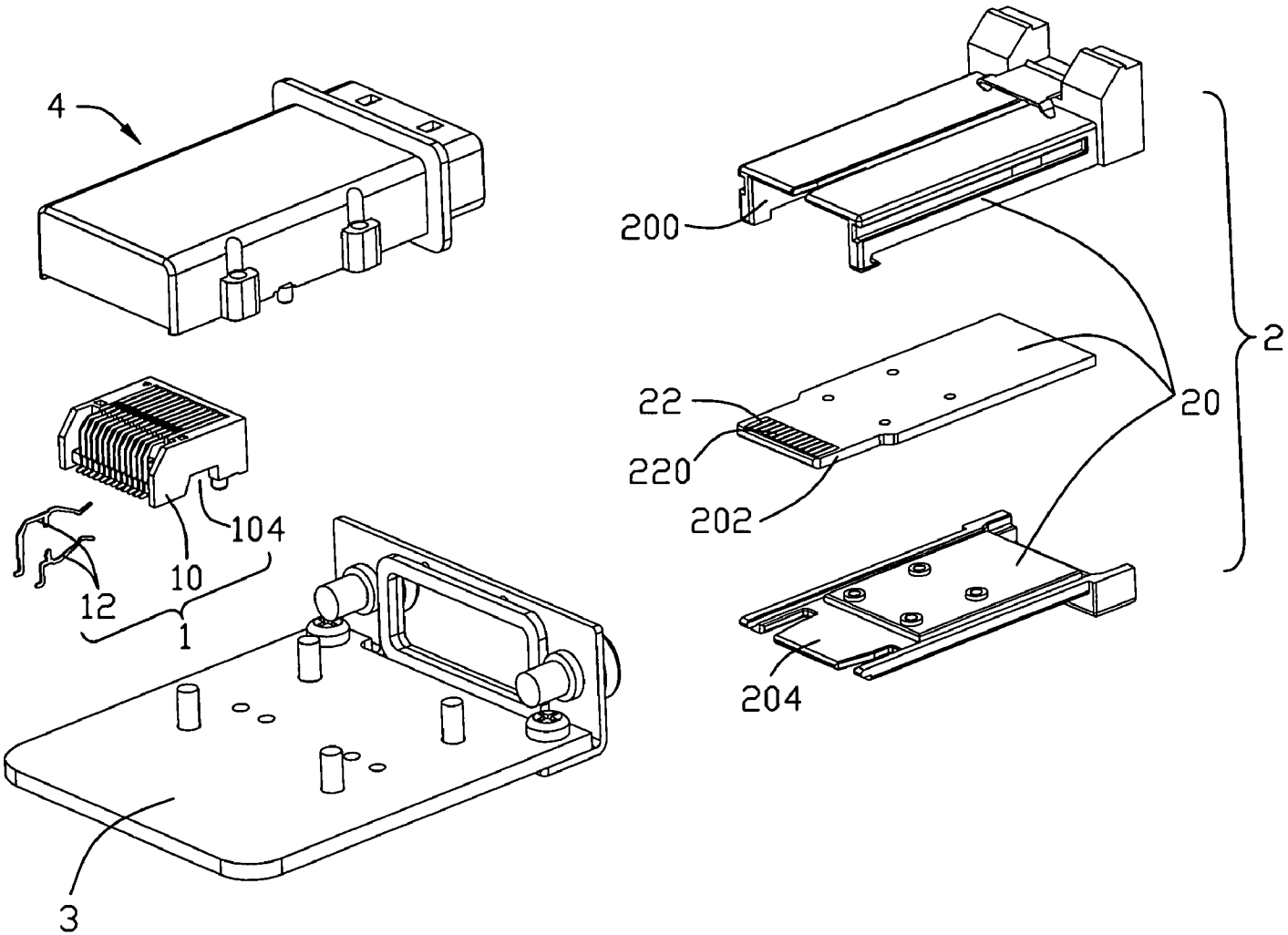
FIG. 1 is an exploded, perspective view of the female electrical connector of a preferred first embodiment of the present invention and a complementary male electrical connector.
Figure 2:
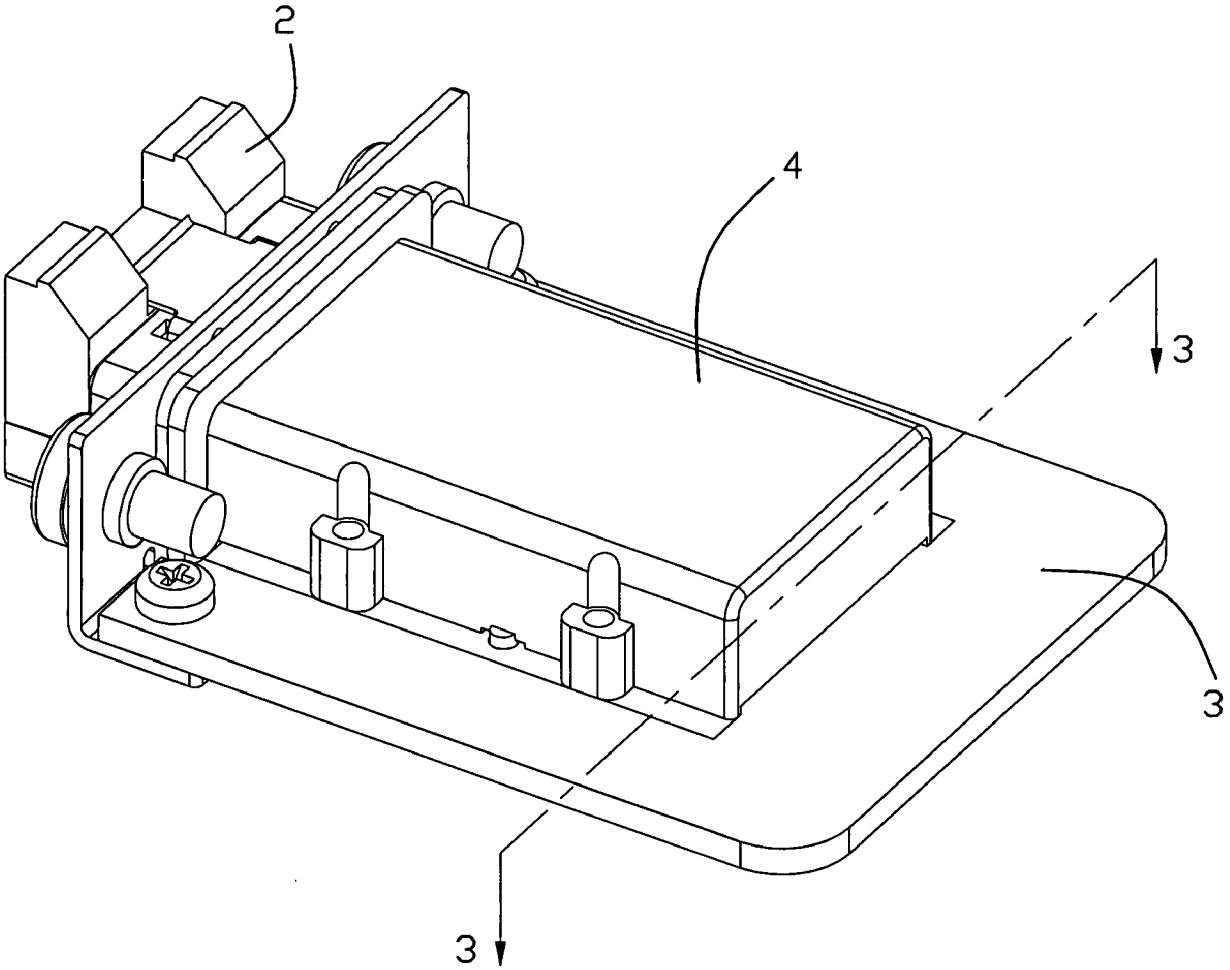
FIG. 2 is an assembled, perspective view of the electrical connectors as shown in FIG. 1.
Figure 3:
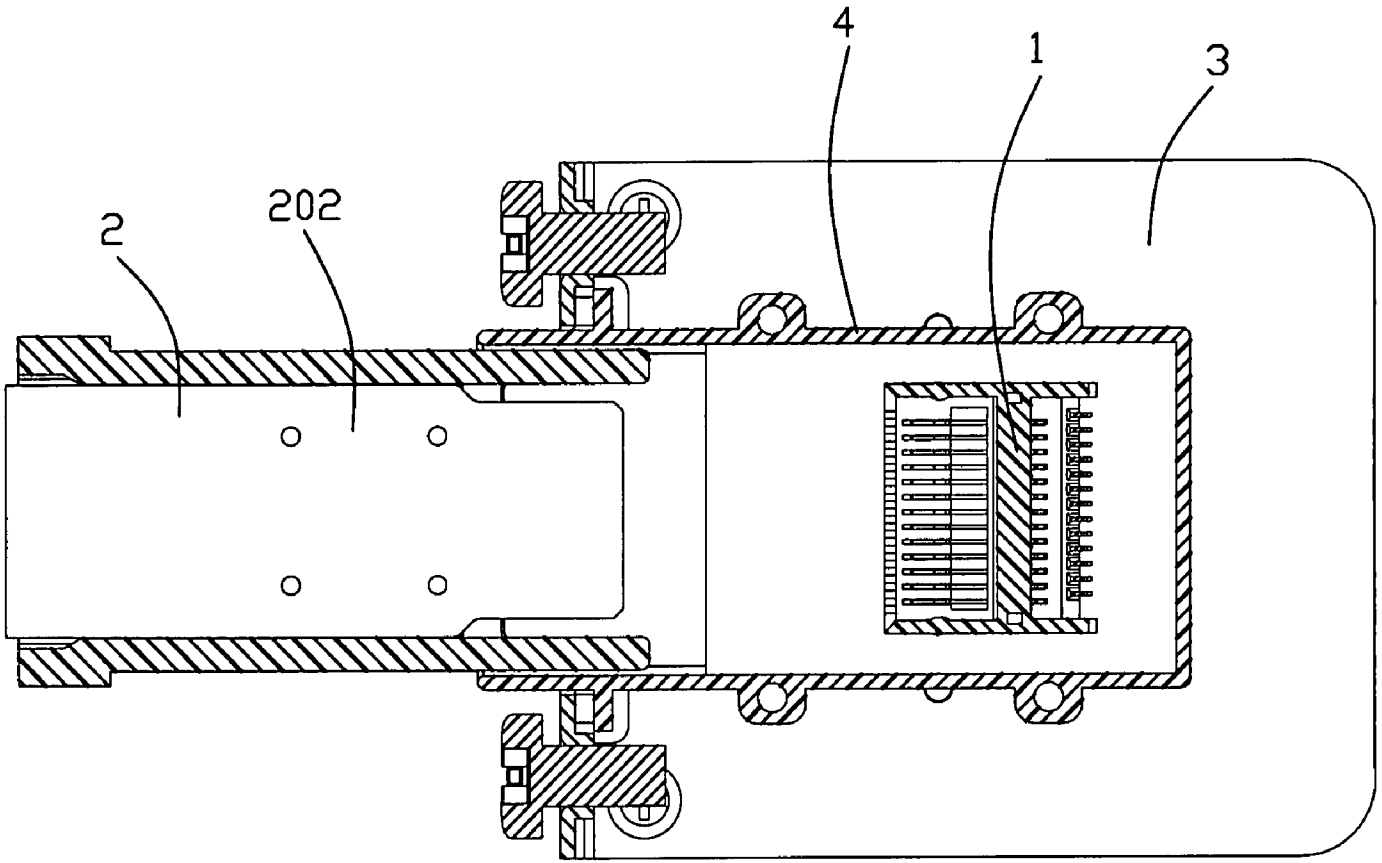
FIG. 3 a cross-sectional view taken along lines 3-3 of FIG. 2, the electrical connectors are not coupled.
Figure 4:
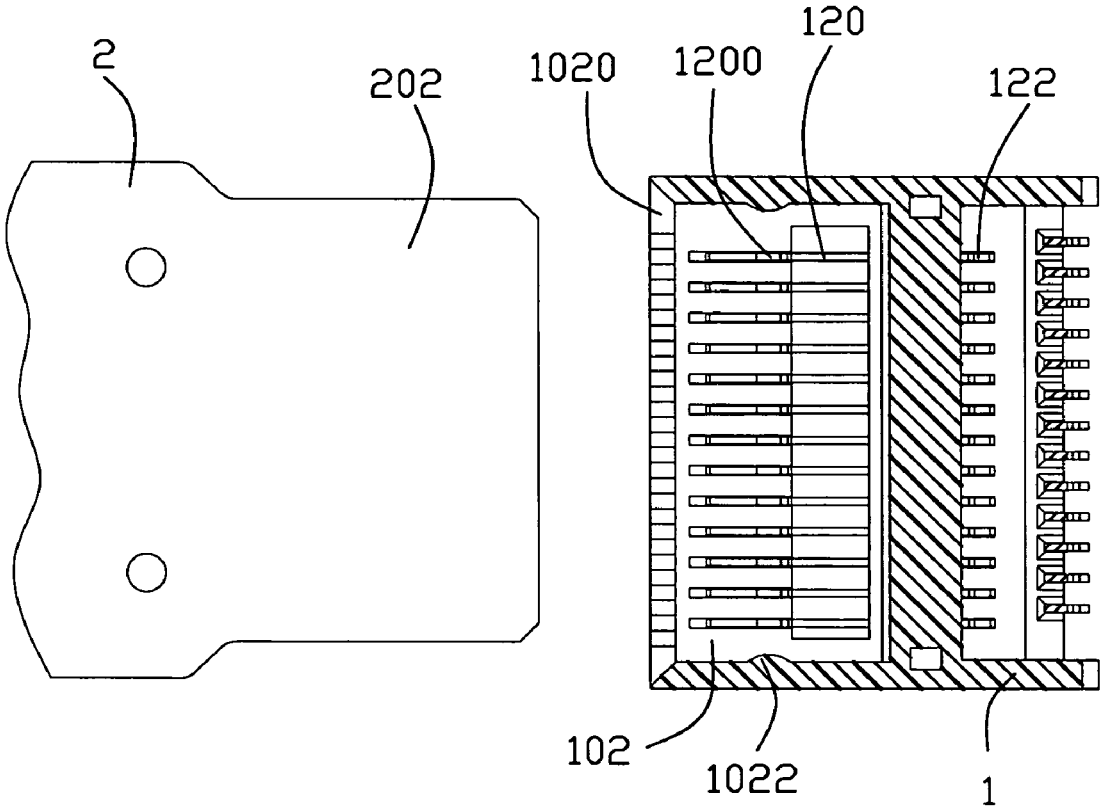
FIG. 4 partial view of the electrical connectors as shown in FIG. 3, illustrates the main mating parts are not coupled.
Figure 5:
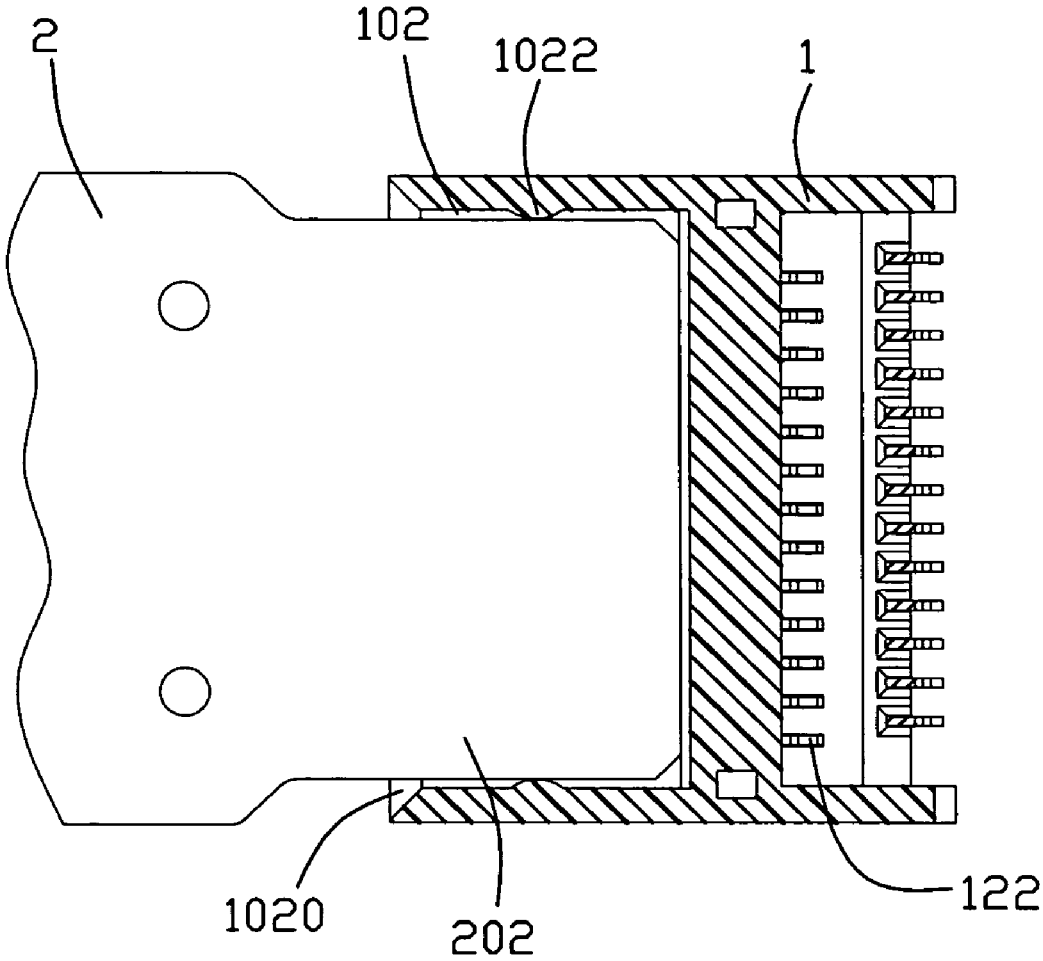
FIG. 5 illustrates the electrical connectors as shown in FIG. 4, the main mating parts are coupled.

Reference will now be made in detail to the preferred embodiment of the present invention.

Referring to FIGS. 1-5, a first embodiment of the present invention illustrated. A female electrical connector 1 comprises a dielectric housing 10 and a plurality of conductive contacts 12. The dielectric housing 10 defines a receiving slot 102 and a recess 104 spaced from the receiving slot 102. The receiving slot 102 comprises opposite upper inner wall (not labeled) and lower inner wall (not labeled), a pair of opposite side inner walls (not labeled) respectively intersecting the upper inner wall (not labeled) and lower inner wall (not labeled), and a pair of fulcrums 1022 respectively defined on the pair of side inner walls (not labeled). The fulcrums 1022 have curved shape with an axis perpendicular to the upper inner wall (not labeled), the width between the pair of fulcrums 1022 is shorter than the width of other position of the pair of side inner walls (not labeled). The receiving slot 102 defining a guiding mouth 1020 having a shape that the outer the position is the wider the width of the guiding mouth 1020 is.

The plurality of conductive contacts 12 is disposed in the dielectric housing 10, arranged in distinct sets of upper contacts 12 and lower contacts 12. Each conductive contact 12 comprises a contacting portion 120 and a mounting tail 122. The contacting portions 120 of the upper set of contacts 12 extend into the receiving slot 102 from the upper wall (not labeled), and the contacting portions 120 of the lower set of contacts 12 extend into the receiving slot 102 from the lower wall (not labeled). The contacting points 1200 of the upper set of contacting portions 120 disposed along a common upper line (not shown), and the contacting points 1200 of the lower set of contacting portions 120 disposed along a common lower line (not shown). The contacting portions 120 of the upper set of contacts 12 and the contacting portions 120 of the lower set of contacts 12 are positioned in alternative relationships. All the contacting points 1200 of the contacting portions 120 are generally in a common plane (not shown), and the center of each fulcrum 102 is also in the common plane (not shown), so the fulcrums 1022 are at the nearest places on the side inner walls to the common upper and lower lines. Each the conductive contact 12 is substantially coplanar, and the mounting tails 122 of the upper contacts 12 are arranged in a line, the mounting tails 122 of the lower contacts 12 are arranged in another line.

The female electrical connector 1 is adapted to providing a connection between a circuit board 3 and a male electrical connector 2. The male electrical connector 2 comprises a dielectric housing 20 and a plurality of conductive contacts 22. The dielectric housing 20 comprises an engaging face 200, a tongue board 202 and a guiding board 204 distinct from and parallel to said tongue board 202. The tongue board 202 is adapted to inserting into the receiving slot 102 of the female connector 1 along an inserting direction (not shown). The tongue board 202 defines a planar mating face (not labeled) parallel to the inserting direction (not shown).

The plurality of conductive contacts 22 are arranged in distinct sets of upper contacts 22 and lower contacts 22. Each the conductive contact 22 comprises a contacting section 220 disposed on the mating face (not labeled) of the tongue board 202. The contacting sections 220 of said upper set of contacts 22 are positioned in alternative relationships to the contacting sections 220 of said lower set of contacts 22.

In use, the female electrical connector 2 is mounted on the printed circuit board 3, and usually, covered by a firm rectangular box shaped cage 4. The female electrical connector 1 is much smaller than the cage 4, and is disposed under the cage 4 at a rear area. So the user can not see the state that the male electrical connector 2 coupling with the female electrical connector 1, the male electrical connector 2 can only couple with the female electrical connector 1 by the guiding of the cage 4 in visionless condition. However, there are manufacture tolerances in the cage 4 and the electrical connectors 1, 2, and there are assembly tolerances when the cage 4 and the female electrical connectors 1 mounted on the printed circuit board 3, further more these manufacture tolerances and assembly tolerances may be accumulated to a large composite tolerance, so the composite tolerance is difficult to control. If there is a tolerance, the inserting direction along which the male electrical connector 2 may couple with the female electrical connector 1 may pivoted an angle from the definite direction. In order to make the manufacture and assembly easy to be done, a large composite tolerance must be acceptable.

In the first embodiment of the present invention, the female electrical connector 1 defines a pair of fulcrums 1022, even the inserting direction pivoted an angle from the definite direction, the tongue board 202 can pivot on the fulcrums, and the position of the tongue board 202 can be restricted within narrow range by limits of the fulcrums 1022. So a proper large tolerance is acceptable under this situation, the manufacture of the electrical connectors 1, 2 and cage 4 is easy to be done, the assembly of the female electrical connectors 1 and the cage 4 with the printed circuit board is also easy to be done. To sum up, the combined efficiency of establish electrical connection between the electrical connectors 1, 2 and the printed circuit board 3 is enhanced.

Figure 6:
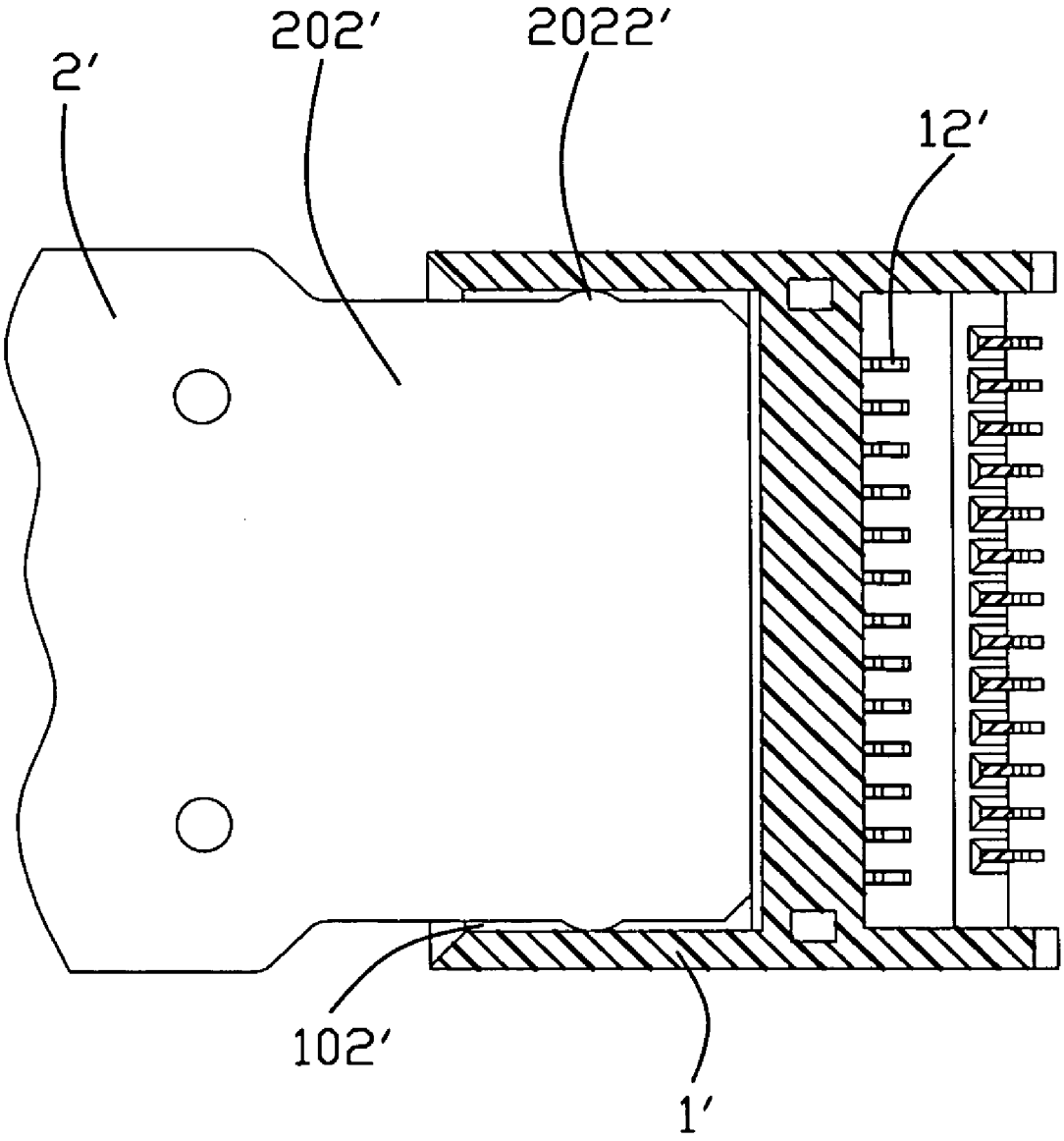
FIG. 6 illustrates the male electrical connectors of a preferred second embodiment of the present invention and a complementary female electrical connector; the main mating parts are coupled.

Referring to FIG. 6, a second embodiment of the present invention illustrated. The female electrical connector 1' defines no fulcrum in its receiving slot 102', but a pair of fulcrums 2022' is symmetrically projecting on two opposite sides of a tongue board 202' of a male electrical connector 2', other features of the electrical connectors 1', 2' in the second embodiment is the same as the electrical connectors 1, 2 in the first embodiment. The mating face (not labeled) of the tongue board 202' is planar, the fulcrums 2022' have curved shape with axis perpendicular to the mating face (not labeled), and the width of the tongue board 202' at the fulcrum 2022' position is longer than at other position. The pair of fulcrums 2022' are positioned adjacent to the contacting section (not shown).

In the second embodiment of the present invention, the male electrical connector 2' defines a pair of fulcrums 2022', even the inserting direction pivoted an angle from the definite direction, the tongue board 202' can pivot on the fulcrums, and the position of the tongue board 202' can be restricted within narrow range by limits of the fulcrums 2022'. So the conductive contacts 12' of the female electrical connector 1' are restricted to electrically connect with the conductive contacts (not shown) of the male electrical connector 2' at a position in a certain narrow range, and a proper large tolerance is accept under this situation, the manufacture of the electrical connectors 1', 2' and cage (not shown) is easy to be done, the assembly of the female electrical connectors 1' and the cage (not shown) with the printed circuit board (not shown) is also easy to be done. To sum up, the combined efficiency of establish electrical connection between the electrical connectors 1', 2' and the printed circuit board (not shown) is enhanced.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A female electrical connector adapted for receiving a male electrical connector, comprising:

a dielectric housing defining a receiving slot for being inserted with a tongue board of the male electrical connector which comprises opposite upper inner wall and lower inner wall, a pair of opposite side inner walls respectively intersecting said upper inner wall and lower inner wall; and a plurality of conductive contacts disposed in said dielectric housing with a contacting portion extending into said receiving slot from said upper wall or lower wall for contacting with an upper face or a bottom face of the tongue board of the male electrical connector and the side inner walls of the receiving slot confronting with opposite lateral edges of the tongue board which intersect the upper and bottom faces of the tongue board;

a pair of fulcrums defined on one of the side inner walls and the lateral edges of the tongue board, respectively;

wherein the side inner walls space away from the lateral edges of the tongue board so that the other of the side inner walls and the lateral edges pivot on the pair of the fulcrums when an engagement of the female and male connector occurs.

2. The female electrical connector as described in claim 1, wherein said dielectric housing further defines a recess spaced from and parallel to said receiving slot.

3. The female electrical connector as described in claim 1, wherein said plurality of conductive contacts are arranged in distinct sets of upper contacts and lower contacts, the contacting portions of said upper set of contacts and the contacting portions of said lower set of contacts are positioned in alternative relationships, and the contacting point of the contacting portions are generally in a common plane, a center of said pair of fulcrums are also in said common plane.

4. The female electrical connector as described in claim 3, wherein each said conductive contact comprises a mounting tail, the mounting tails of the upper contacts arranged in a line, the mounting tail of the lower contacts arranged in another line.

5. The female electrical connector as described in claim 1, wherein said fulcrums are defined with a bump shape to provide as a fulcrum pivot.

6. The female electrical connector as described in claim 1, wherein said receiving slot defines a guiding mouth which has a larger width at an outer position.

7. The female electrical connector as described in claim 5, wherein the pair of the fulcrums unitarily protrude in the receiving slot from the side inner walls.

8. A male electrical connector comprising:

a dielectric housing comprising a tongue board adapted to insert in a elongate rectangular receiving slot of a complementary female connector along inserting direction, said tongue board defining a mating face parallel to said inserting direction; and a plurality of conductive contacts each comprising a contacting section disposed on said mating face of said tongue board;

wherein a pair of fulcrums symmetrically projecting on two opposite sides of said tongue board being positioned adjacent to said contacting section;

wherein said dielectric housing further defines a guiding board distinct from and parallel to said tongue board.

9. The male electrical connector as described in claim 8, wherein said plurality of conductive contacts are arranged in distinct sets of upper contacts and lower contacts, the contacting sections of said upper set of contacts are positioned in alternative relationships to the contacting sections of said lower set of contacts.

10. The male electrical connector as described in claim 8, wherein said mating face of said tongue board is planar, said fulcrums have curved shape with axis perpendicular to said mating face, the width of said tongue board at the fulcrum position is longer than at other position.

11. An electrical connector assembly comprising:

a first printed circuit board;

a cage mounted upon the first printed circuit board;

a first connector mounted upon the first printed circuit board and enclosed in said cage, said first connector defining a first housing with a receiving slot in a front portion thereof, and a plurality of first contacts disposed in the housing with contact sections extending into the receiving slot; and a second connector matable with the first connector and including a second housing enclosing a second printed circuit board therein; wherein the second housing is located between the cage and the first housing and the second printed circuit board is received in the receiving slot; wherein each of two side walls of the second housing, is transversely sandwiched between a corresponding side wall of the first housing and a corresponding side wall of the cage, and said corresponding side wall of the first housing is transversely sandwiched between the second printed circuit board and the corresponding side wall of the cage under a condition that one of said second printed circuit board and said corresponding side wall of the first housing defines a protrusion laterally toward and against the other for stabilizing insertion of the second printed circuit board into the receiving slot.

* * * * *